US006758229B2

(12) United States Patent
Wang

(10) Patent No.: US 6,758,229 B2
(45) Date of Patent: Jul. 6, 2004

(54) UMBRELLA FRAME DEVICE

(75) Inventor: Max Wang, No. 19, Ta-Yuan 13th St., Tai-Ping City, Taichung Hsien (TW)

(73) Assignee: Max Wang (TW)

( * ) Notice: Subject to any disclaimer, the term of this patent is extended or adjusted under 35 U.S.C. 154(b) by 0 days.

(21) Appl. No.: 10/348,486

(22) Filed: Jan. 21, 2003

(65) Prior Publication Data

US 2004/0107980 A1 Jun. 10, 2004

(51) Int. Cl.[7] ..... A45B 25/08
(52) U.S. Cl. ..... 135/41; 135/42; 135/39
(58) Field of Search ..... 135/39, 38, 43, 135/41, 40

(56) References Cited

U.S. PATENT DOCUMENTS 3,856,032 A * 12/1974 Schafer ..... 135/28
5,588,455 A * 12/1996 Kuo ..... 135/28
5,615,698 A * 4/1997 Ko ..... 135/28
5,911,233 A * 6/1999 Wu ..... 135/28
6,006,771 A * 12/1999 Wu ..... 135/41
6,216,712 B1 * 4/2001 Lin et al. ..... 135/31
6,431,191 B1 * 8/2002 Wang ..... 135/40
2002/0179130 A1 * 12/2002 Ko ..... 135/39

* cited by examiner

*Primary Examiner*—Leslie A. Braun
*Assistant Examiner*—Amy J. Sterling
(74) *Attorney, Agent, or Firm*—Webb Ziesenheim Logsdon Orkin & Hanson, P.C.

(57) ABSTRACT

An umbrella frame device includes a runner slidably sleeved on a stem for spreading and collapsing a canopy. A retaining member has a retaining end which is movable radially in a slot in the runner and which is extendable inwardly of the runner to slidably contact a slideway on a protuberance disposed on the stem. The retaining end is brought to slip over an upper edge of the protuberance so as to be retained on a shoulder when the runner is moved to an engaging position. A sleeve member surrounds and is movable relative to the runner, and has a cam surface portion which can depress the retaining end radially with a friction force that arrests the runner in the engaging position.

12 Claims, 6 Drawing Sheets

UMBRELLA FRAME DEVICE

BACKGROUND OF THE INVENTION

1. Field of the Invention

This invention relates to an umbrella frame device, more particularly to an umbrella frame device with a sleeve member which is operable to move a runner between engaging and disengaging positions.

2. Description of the Related Art

A conventional umbrella is shown to include an elongate stem with an upper elongate hole in which a spring-loaded stop is provided. A runner is sleeved slidably on the stem to support a rib assembly which is mounted on an upper end of the stem. The runner is movable along the stem between an upper position for stretching the rib assembly and a lower position for collapsing the same. At the upper position, the runner is retainingly supported by the stop.

In view of the fact that the stem of the conventional umbrella frame device has to be provided with the hole to receive the stop, a solid structure was not contemplated for the stem. Due to this inherent limitation of the stem, which is a primary part of the umbrella frame device in terms of strength, it is quite difficult to improve the rigidity of the stem, and hence the durability of the umbrella frame device. Moreover, it is uncomfortable to press an end of the stop for collapsing the rib assembly, which has an acute and rigid surface.

SUMMARY OF THE INVENTION

The object of the present invention is to provide an umbrella frame device which can be operated conveniently and comfortably to spread and collapse a canopy, and which has a simple construction to facilitate assembly.

According to this invention, the umbrella frame device includes an elongate stem which has an outer surrounding stem surface that extends along and that surrounds an axis in an axial direction. The outer surrounding stem surface has an upper end portion on which a canopy is adapted to be mounted, a lower end portion, and a middle portion between the upper and lower end portions.

A protuberance is disposed on the middle portion adjacent to the upper end portion, extends in the axial direction, and has a slideway thereon. The slideway terminates at an upper edge that forms a shoulder with the middle portion. The shoulder extends inwardly and radially of the upper edge.

A tubular runner is sleeved on and is movable relative to the stem between upper and lower positions respectively for spreading and collapsing the canopy. The runner has inner and outer surrounding runner surfaces opposite to each other in radial directions relative to the axis. The outer surrounding runner surface has a slot which extends radially through the inner surrounding runner surface. The inner surrounding runner surface is movable along the slideway.

A retaining member has a retaining end which is disposed to be movable radially in the slot and which is extendable inwardly of the inner surrounding runner surface to slidably contact the slideway. The retaining end is brought to slip over the upper edge so as to be retained on the shoulder when the inner surrounding runner surface is moved along the slideway relative to the axis from a disengaging position which corresponds to the lower position, to an engaging position which corresponds to the upper position.

A sleeve member has an inner surrounding sleeve surface which surrounds the outer surrounding runner surface, and which is movable relative to the outer surrounding runner surface along the axis. The inner surrounding sleeve surface has a cam surface portion which confronts the retaining member and which is configured to be disengaged from the retaining end of the retaining member when the runner is in the lower position and to depress the retaining end radially with a friction force that arrests the inner surrounding runner surface in the engaging position, while the sleeve member is held against gravity by the retaining member.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
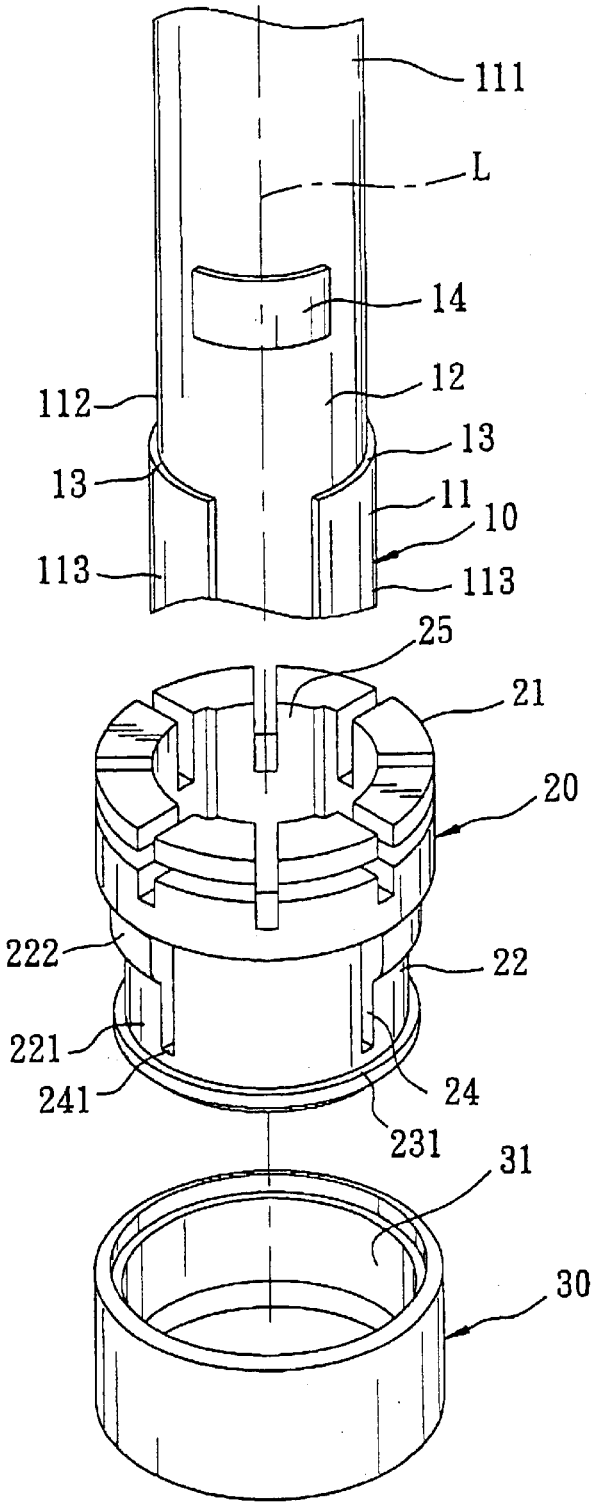
FIG. 1 is a fragmentary exploded perspective view of the first preferred embodiment of an umbrella frame device according to this invention.

Before the present invention is described in greater detail, it should be noted that same reference numerals have been used to denote like elements throughout the specification.

Figure 2:
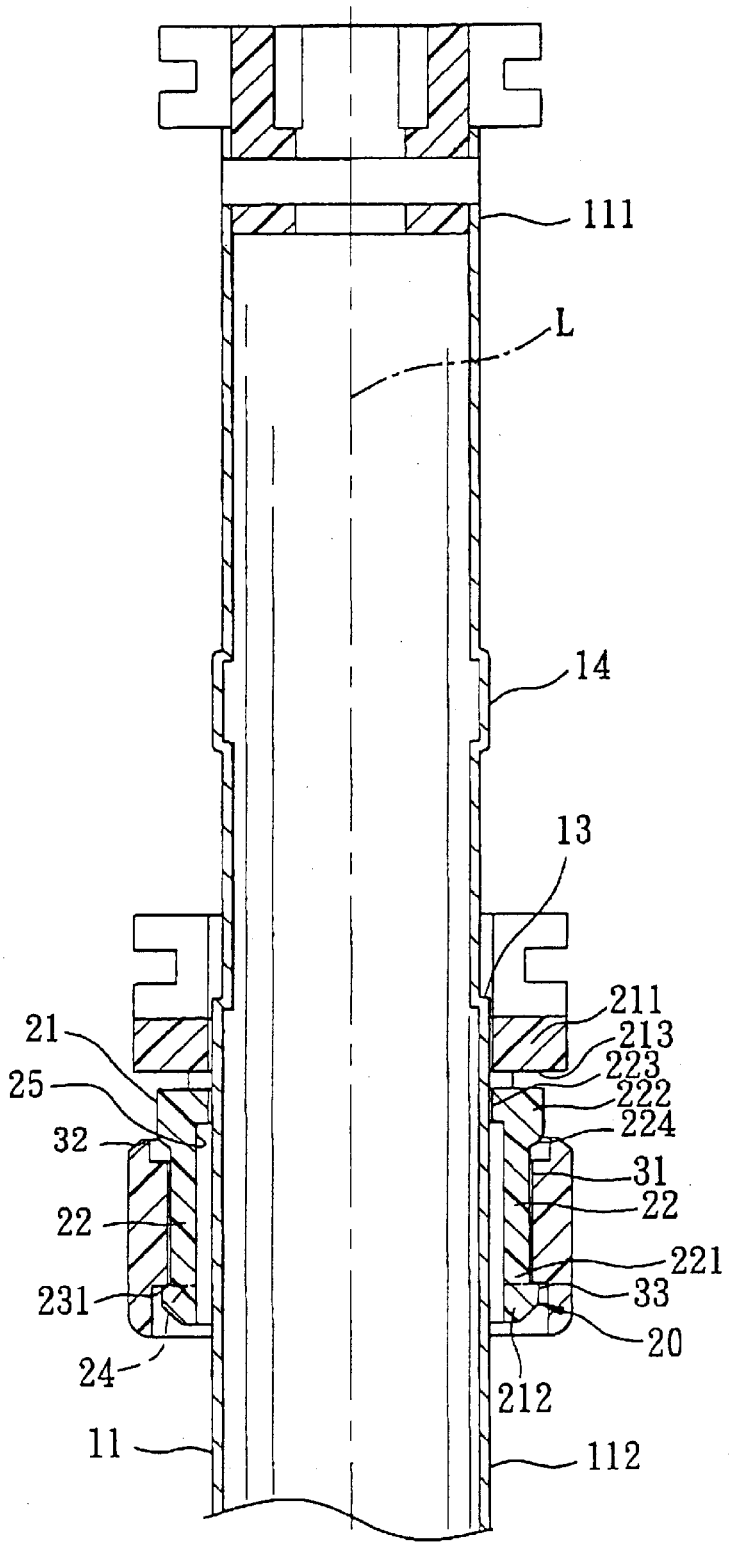
FIG. 2 is a fragmentary sectional view showing a runner of the umbrella frame device in a disengaging state.
Figure 3:
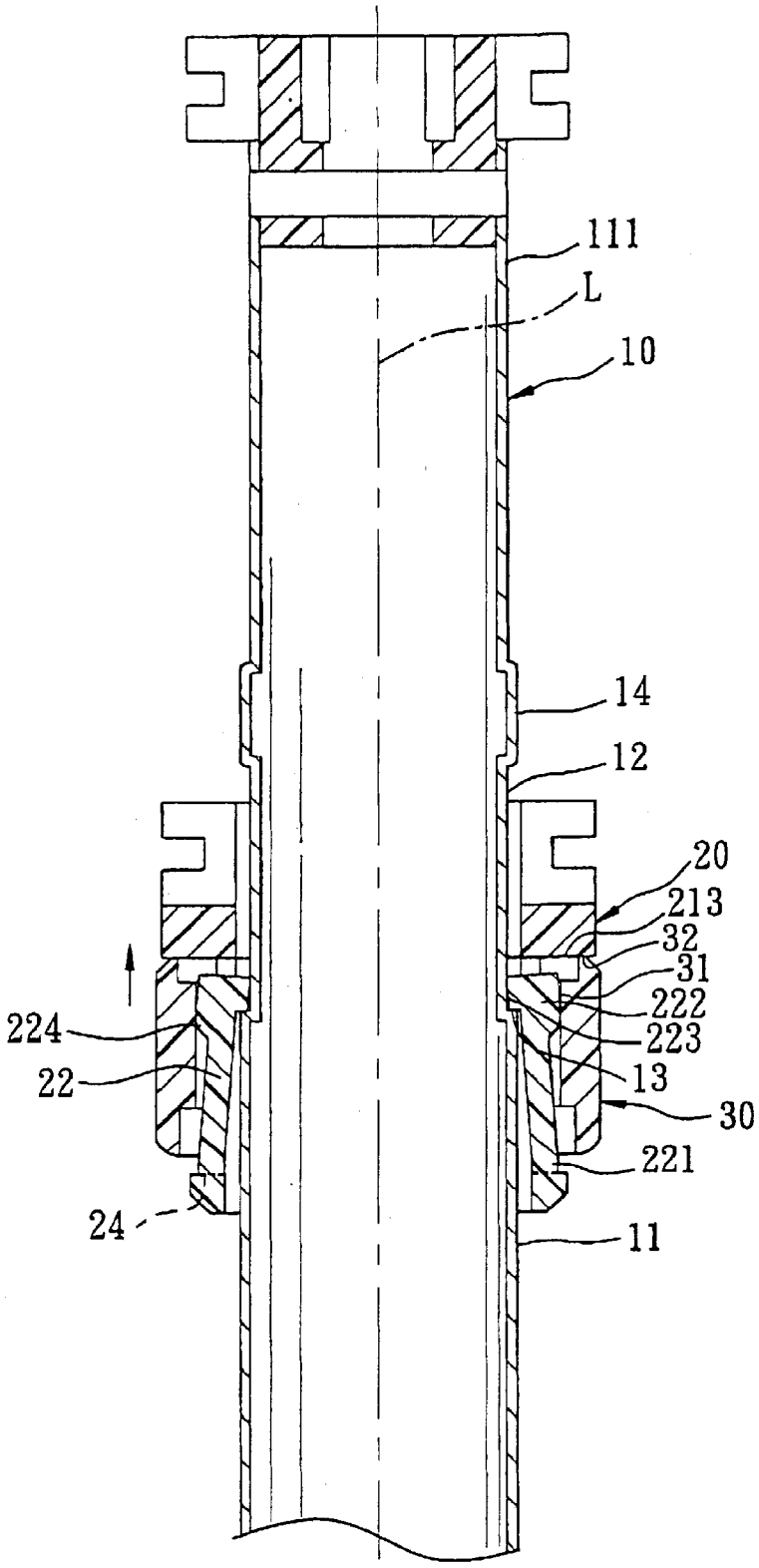
FIG. 3 is a fragmentary sectional view showing the runner in an engaging state.

Referring to FIGS. 1 to 3, the first preferred embodiment of an umbrella frame device according to the present invention is shown to comprise an elongate stem 10, a tubular runner 20 which is sleeved on and which is movable relative to the stem 10 between upper and lower positions for spreading and collapsing a canopy (not shown), and a sleeve member 30.

The stem 10 has an outer surrounding stem surface 11 which extends along and which surrounds an axis (L) in an axial direction. The outer surrounding stem surface 11 has an upper end portion 111 on which the canopy is adapted to be mounted, a lower end portion, and a middle portion 112 between the upper end portion 111 and the lower end portion. A pair of arcuate protuberances 113 are disposed on the middle portion 112 adjacent to the upper end portion 111, extend in the axial direction, and respectively have slideways thereon. Each of the slideways terminates at an upper edge that forms a shoulder 13 with the middle portion 112. The shoulder 13 extends inwardly and radially of the upper edge. Alternatively, the protuberances 113 may be integrally formed with the middle portion 112. In addition, the protuberances 113 may be formed by punching of the stem 10. A limiting protrusion 14 projects outwardly from the upper end portion 111.

The runner 20 has inner and outer surrounding runner surfaces 25,21 opposite to each other in radial directions relative to the axis (L). The outer surrounding runner surface 21 has a pair of slots 24 which extend radially through the inner surrounding runner surface 25 and which extend downwardly to terminate at lower edge walls 241, respectively. The inner surrounding runner surface 25 is movable along the slideways of the protuberances 113. A pair of retaining members 22 are formed on the runner 20. Each of the retaining members 22 has a fixed end 221 which is integrally connected to the respective lower edge wall 241, a retaining end 222 which is opposite to the fixed end 221 in the axial direction and which has a biasing force that urges the retaining end 222 to move radially and outwardly. Thus, the retaining end 222 is movable radially in the respective slot 24, and is extendable inwardly of the inner surrounding runner surface 25 to slidably contact the respective slideway. Moreover, the retaining end 222 has an inner protrusion 223 which projects towards the axis (L), and an outer contact bump 224 which extends radially and away from the inner protrusion 223. When the inner surrounding runner surface 25 is moved along the slideways relative to the axis (L) from a disengaging position, as shown in FIG. 2, which corresponds to the lower position of the runner 20, to an engaging position, as shown in FIG. 3, which corresponds to the upper position of the runner 20, the retaining end 222 is brought to slip over the upper edge of the respective protuberance 113 against the biasing force, with the inner protrusion 223 abutting against the respective shoulder 13 so as to be retained on the shoulder 13. Furthermore, an annular upper limiting member 213 is formed on an upper portion 211 of the runner 20. An annular lower limiting member 231 is formed on a lower portion 212 of the runner 20.

The sleeve member 30 has an inner surrounding sleeve surface which surrounds the outer surrounding runner surface 21, and which is movable relative to the outer surrounding runner surface 21 along the axis (L). The inner surrounding sleeve surface has a cam surface portion 31 which confronts the retaining members 22. In this embodiment, the cam surface portion 31 extends in the axial direction, and is disengaged from the retaining ends 222 of the retaining members 22 when the runner 20 is in the lower position, as shown in FIG. 2. The cam surface portion 31 can depress the outer contact bumps 224 of the retaining ends 222 radially with a friction force that arrests the inner surrounding runner surface 25 in the engaging position, while the sleeve member 30 is held against gravity by the retaining members 22, as shown in FIG. 3. In addition, the sleeve member 30 has an upper edge wall 32 and a lower edge wall 33 opposite to each other in the axial direction.

When the sleeve member 30 is operated to move upwardly relative to the stem 10, the runner 20 can be moved upwardly due to the arrangement of the outer contact bumps 224. The inner protrusions 223 are then brought to slip over the upper edges of the protuberances 113, respectively, to be retained on the shoulders 13 as a result of depression of the outer contact bumps 224 by the cam surface portion 31 so as to place the inner surrounding runner surface 25 in the engaging position, as shown in FIG. 3, thereby spreading the canopy. The upward movement of the runner 20 is limited by the limiting protrusion 14. In this state, the upper edge wall 32 of the sleeve member 30 is limited by the upper limiting member 213 so as to prevent removal of the sleeve member 30 from the runner 20 in the axial direction.

When it is desired to collapse the canopy, the sleeve member 30 is pulled downwardly towards the lower end portion of the stem 10. By means of the biasing force of the retaining members 22, the retaining ends 222 car be moved away from the axis (L) to disengage from the shoulders 13, thereby permitting downward movement of the sleeve member 30 and the runner 20 towards the lower end portion of the stem 10, as shown in FIG. 2. The lower edge wall 33 of the sleeve member 30 is limited by the lower limiting member 231 to prevent removal of the sleeve member 30 from the runner 20 in the axial direction.

As illustrated, the umbrella frame device according to this invention has the following advantages:

1. Since the stem 10 does not have to be formed with a hole, which will weaken the structural strength of the stem, the stem 10 can be constructed to be relative slim, thereby reducing the overall weight of the umbrella frame device.

2. The stem 10, the runner 20 and the sleeve member 30 are simple in construction, and are easy to assemble.

3. When spreading and collapsing the canopy, the user can press the sleeve member 30 to move the runner 20 to the upper and lower positions. As such, it is convenient and comfortable for the user to operate the umbrella frame device.

Figure 4:
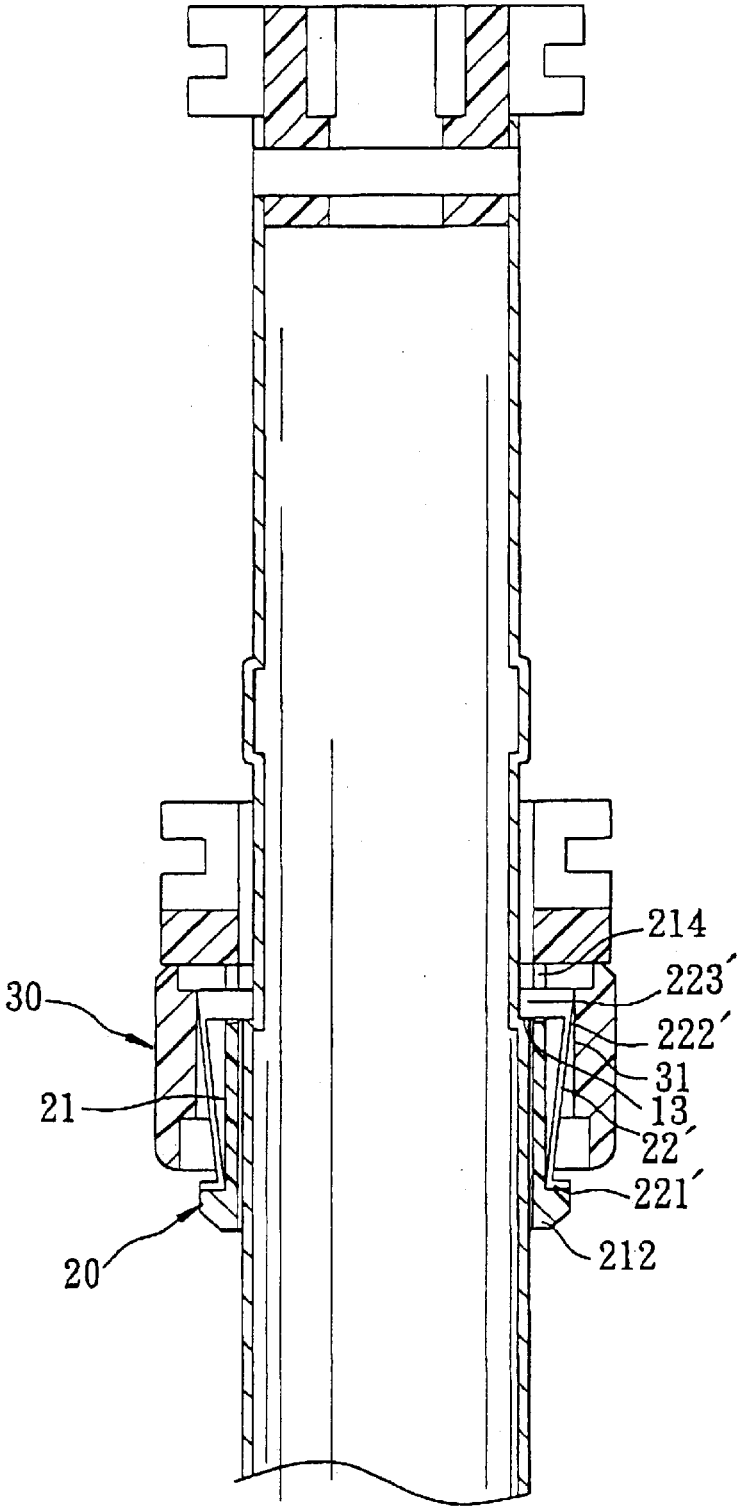
FIG. 4 is a fragmentary sectional view of the second preferred embodiment of an umbrella frame device according to this invention.

Referring to FIG. 4, the second preferred embodiment of an umbrella frame device according to this invention is shown to be similar to that of the first preferred embodiment in construction, except that each of the retaining members 22' is made from a leaf spring having a biasing force, and has a fixed end 221' that is secured to the outer surrounding runner surface 21 of the runner 20 proximate to the lower portion 212 of the runner 20, and a retaining end 222' opposite to the fixed end 221' in the axial direction. The retaining end 222' has an outer contact portion which extends radially and outwardly of the outer surrounding runner surface 21 and which is disposed to be depressed by the cam surface portion 31 of the sleeve member 30 against the-biasing force such that an inner protrusion 223' of the retaining end 222' can be retained on the respective shoulder 13.

Figure 5:
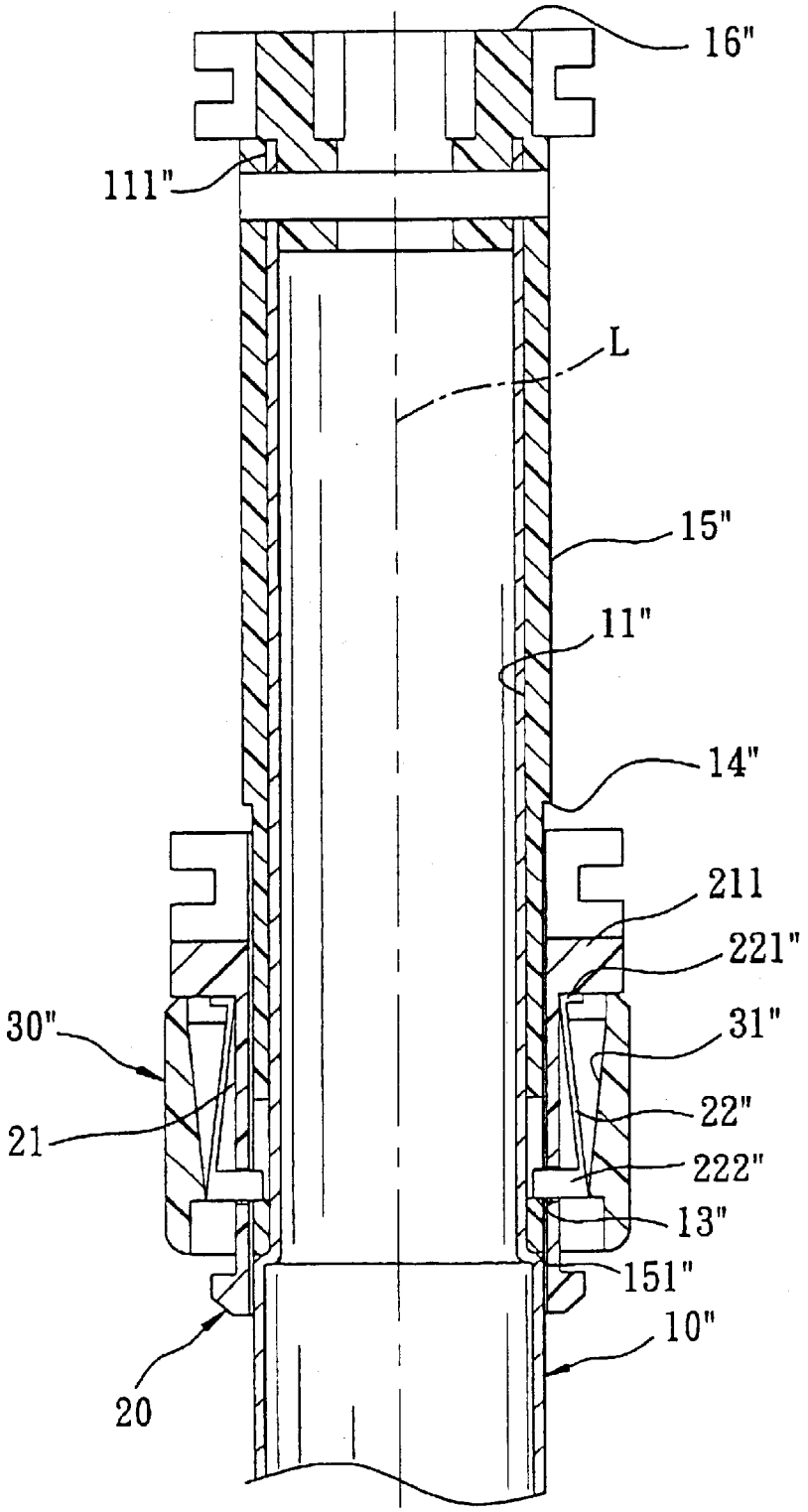
FIG. 5 is a fragmentary sectional view of the third preferred embodiment of an umbrella frame device according to this invention.

Referring to FIG. 5, the third preferred embodiment of an umbrella frame device according to this invention is shown to be similar to that of the second preferred embodiment in construction, except that each of the retaining members 22" is made from a leaf spring having a biasing force, and has a fixed end 221" that is secured to the outer surrounding runner surface 21 of the runner 20 proximate to the upper portion 211 of the runner 20, a retaining end 222" which is opposite to the fixed end 221" in the axial direction. The retaining end 222" has an outer contact portion which extends radially and outwardly of the outer surrounding runner surface 21. In addition, the cam surface portion 31" of the sleeve member 30" is gradually inclined upwardly and outwardly relative to the axis (L) so as to depress the outer contact portion against the biasing force when the sleeve member 30" is moved upwardly relative to the outer surrounding runner surface 21.

Furthermore, a tubular member 15" is integrally formed with a top mount 16" that is provided on the upper end portion 111" of the outer surrounding stem surface 11" of the stem 10", and is sleeved on the upper end portion 111" and the middle portion of the outer surrounding stem surface 11". The tubular member 15" is formed with an annular limiting portion 14" that is formed as a shoulder for limiting upward movement of the runner 20. The tubular member 15" extends downwardly to terminate at a surrounding bottom edge wall 151", and has a pair of hole confining walls 13", each of which is formed adjacent to the bottom edge wall 151" and each of which extends radially of the axis to confine a hole. The hole confining wall 13" has a lower wall portion which serves as the shoulder 13, as described in the previous embodiments. Therefore, the slideways in this embodiment are disposed between the lower wall portion and the bottom edge wall 151".

Figure 6:
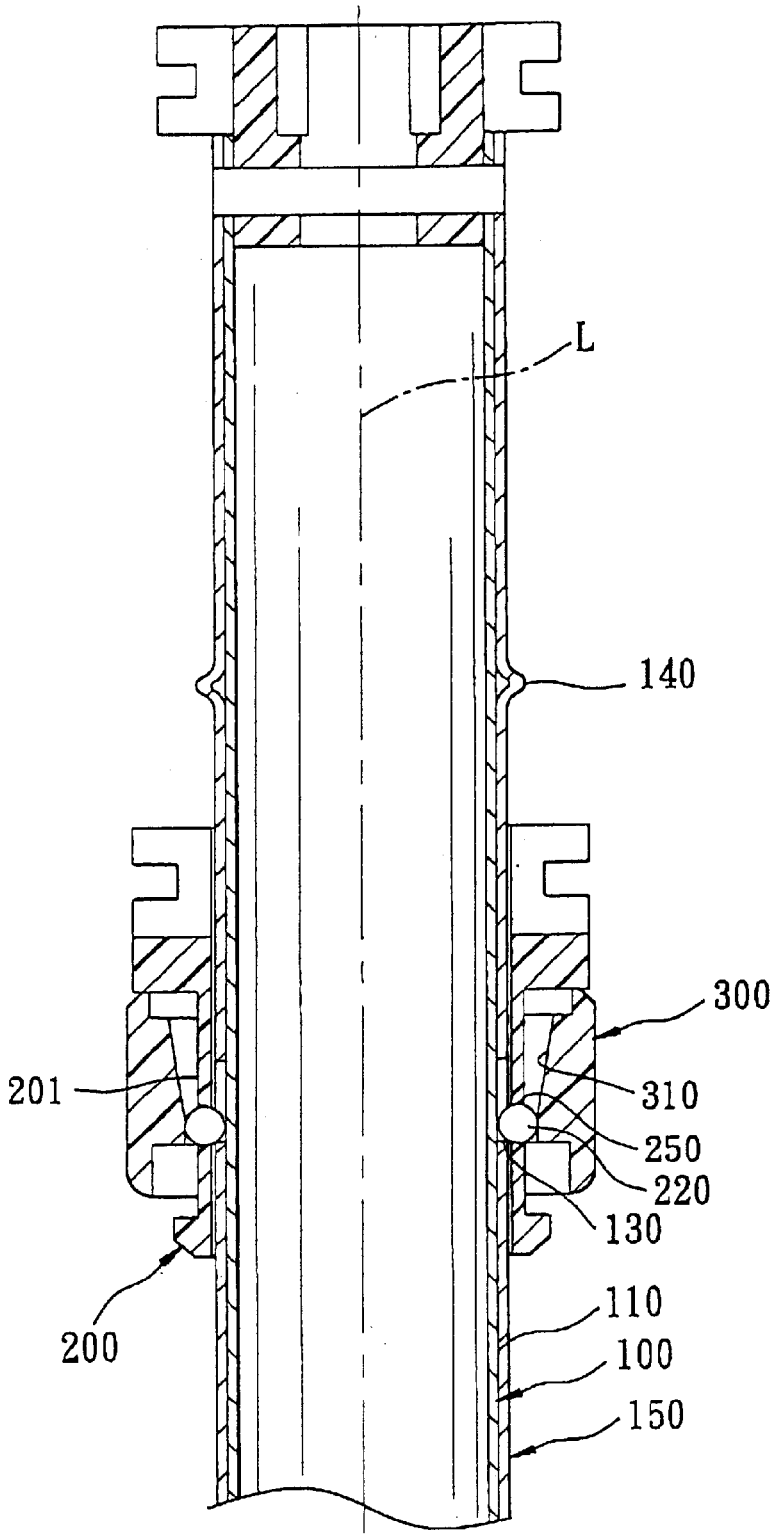
FIG. 6 is a fragmentary sectional view of the fourth preferred embodiment of an umbrella frame device according to this invention.

Referring to FIG. 6, the fourth preferred embodiment of an umbrella frame device according to this invention is shown to be similar to that of the third preferred embodiment in construction, except that each of the retaining members 220 is a ball which has contact and retaining ends that are diametrically opposite to each other. The contact end is disposed outwardly of the slot 250 in the runner 200. The cam surface portion 310 of the sleeve member 300 is gradually inclined upwardly and outwardly relative to the axis (L) so as to depress the contact end when the sleeve member 300 is moved upwardly relative to the outer surrounding runner surface 201. In addition, a tubular member 150, similar to the tubular member 15" of the third preferred embodiment, is disposed to sleeve on the upper end portion and the middle portion of the outer surrounding stem surface 110 of the stem 100. The tubular member 150 is integrally formed with a limiting ring 140, and a pair of hole confining walls 130, each of which extends radially of the axis (L) to confine a hole. The hole confining wall 130 has a lower wall portion which serves as the shoulder 13, as described in the previous embodiments. Therefore, the slideways in this embodiment are disposed downwardly of the lower wall portion.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. An umbrella frame device for spreading and collapsing a canopy, comprising:

an elongate stem having an outer surrounding stem surface which extends along and which surrounds an axis in an axial direction, said outer surrounding stem surface having an upper end portion on which the canopy is adapted to be mounted, a lower end portion, and a middle portion between said upper and lower end portions;

a protuberance disposed on said middle portion adjacent to said upper end portion, extending in the axial direction, and having a slideway thereon, said slideway terminating at an upper edge that forms a shoulder with said middle portion, said shoulder extending inwardly and radially of said upper edge;

a tubular runner sleeved on and movable relative to said stem between upper and lower positions for spreading and collapsing the canopy, said runner having inner and outer surrounding runner surfaces opposite to each other in radial directions relative to the axis, said outer surrounding runner surface having a slot which extends radially through said inner surrounding runner surface, said inner surrounding runner surface being movable along said slideway;

a retaining member having a retaining end which is disposed to be movable radially in said slot and extendable inwardly of said inner surrounding runner surface to slidably contact said slideway, said retaining end being brought to slip over said upper edge so as to be retained on said shoulder when said inner surrounding runner surface is moved along said slideway relative to the axis from a disengaging position which corresponds to the lower position, to an engaging position which corresponds to the upper position;

a sleeve member having an inner surrounding sleeve surface which surrounds said outer surrounding runner surface, and which is movable relative to said outer surrounding runner surface along the axis, said inner surrounding sleeve surface having a cam surface portion which confronts said retaining member and which is configured to be disengaged from said retaining end of said retaining member when said runner is in the lower position and to depress said retaining end radially with a friction force that arrests said inner surrounding runner surface in the engaging position, while said sleeve member is held against gravity by said retaining member.

2. The umbrella frame device of claim 1, wherein said cam surface portion extends in the axial direction.

3. The umbrella frame device of claim 2, wherein said slot extends towards said lower end portion to terminate at a lower edge wall, said retaining member having a fixed end which is integrally connected to said lower edge wall, and which is opposite to said retaining end in the axial direction such that said retaining end acquires a biasing force that urges said retaining end to move radially and outwardly.

4. The umbrella frame device of claim 3, wherein said retaining end has an inner protrusion that projects towards the axis to abut against said shoulder when said inner surrounding runner surface is in the engaging position, and an outer contact bump that extends radially and away from said inner protrusion and that is configured to be depressed by said cam surface portion against the biasing force.

5. The umbrella frame device of claim 2, wherein said retaining member is made from a leaf spring having a biasing force, and has a fixed end that is opposite to said retaining end in the axial direction, and that is secured to said outer surrounding runner surface proximate to said lower end portion, said retaining end having an outer contact portion which extends radially and outwardly of said outer surrounding runner surface so as to be depressed by said cam surface portion against the biasing force.

6. The umbrella frame device of claim 1, wherein said retaining member is made from a leaf spring having a biasing force, and has a fixed end that is opposite to said retaining end in the axial direction, and that is secured to said outer surrounding runner surface proximate to said upper end portion, said retaining end having an outer contact portion which extends radially and outwardly of said outer surrounding runner surface so as to be depressed by said cam surface portion against the biasing force.

7. The umbrella frame device of claim 6, wherein said cam surface portion is gradually inclined upwardly and outwardly relative to the axis so as to depress said outer contact portion when said sleeve member is moved upwardly relative to said outer surrounding runner surface.

8. The umbrella frame device of claim 1, wherein said retaining member is a ball which has a contact end that is diametrically opposite to said retaining end, and that is disposed outwardly of said slot, said cam surface portion being gradually inclined upwardly and outwardly relative to the axis so as to depress said contact end when said sleeve member is moved upwardly relative to said outer surrounding runner surface.

9. The umbrella frame device of claim 1, wherein said protuberance is integrally formed with said outer surrounding stem surface.

10. The umbrella frame device of claim 9, wherein said protuberance is formed by punching said stem.

11. The umbrella frame device of claim 1, further comprising a tubular member that is sleeved on said upper end portion and said middle portion, and that extends downwardly to terminate at a surrounding bottom edge wall, said tubular member having a hole confining wall which is formed adjacent to said bottom edge wall and which extends radially of the axis to confine a hole, said hole confining wall having a lower wall portion which serves as said shoulder, said slideway being disposed between said lower wall portion and said bottom edge wall.

12. The umbrella frame device of claim 1, further comprising lower and upper limiting members disposed to prevent removal of said sleeve member from said runner in the axial direction.

* * * * *